United States Patent [19]

Edwards

[11] 4,061,174

[45] Dec. 6, 1977

[54] FIXING OF SHAPED BODIES TO METAL CASTING MOULDS

[75] Inventor: Bryan William Edwards, Birmingham, England

[73] Assignee: Foseco International Limited, Birmingham, England

[21] Appl. No.: 737,792

[22] Filed: Nov. 1, 1976

[30] Foreign Application Priority Data

Dec. 5, 1975 United Kingdom ..... 50025/75

[51] Int. Cl.[2] ..... B22C 9/00; B22D 7/00

[52] U.S. Cl. ..... 164/6; 164/DIG. 6; 249/103

[58] Field of Search ..... 164/6, 100, DIG. 6; 249/103

[56] References Cited

U.S. PATENT DOCUMENTS 3,189,958 6/1965 Newbold ..... 164/133 X 3,934,639 1/1976 McCrainor et al. ..... 164/100

*Primary Examiner*—Robert L. Spicer, Jr.

*Attorney, Agent, or Firm*—Cushman, Darby and Cushman

[57] ABSTRACT

The invention relates to a method of fixing a shaped body of a refractory material to an interior face (e.g. of a wall) of an ingot mould in which an adhesive composition is applied to either the body or the face or both and the body and the face are urged together, the thus fixed body serving to identify an ingot when cast in the mould. In the method of the invention the adhesive composition is a mixture consisting essentially of aqueous alkali metal silicate such as sodium silicate and a particulate refractory material such as china clay, silica or zircon, the mixture having a viscosity of at least 2000 poises measured on a Brookfield Viscometer model RVT at 20° C.

11 Claims, 1 Drawing Figure

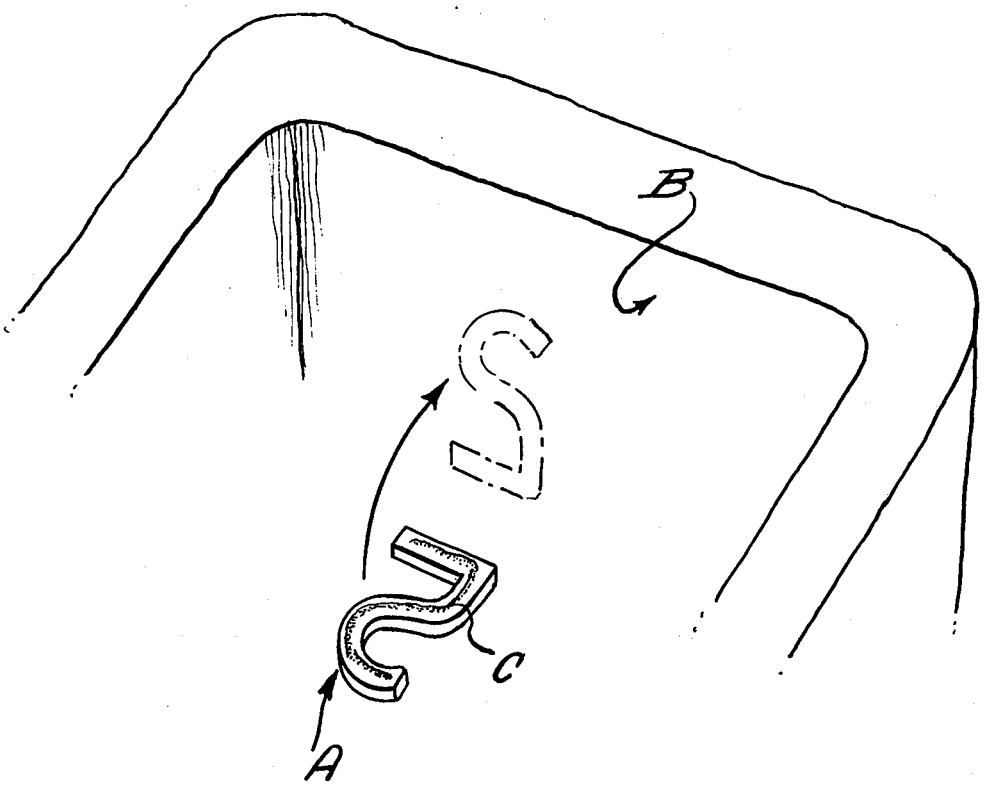
B
C
A

FIXING OF SHAPED BODIES TO METAL CASTING MOULDS

BACKGROUND AND SUMMARY OF THE INVENTION

This invention relates to the fixing of shaped bodies to metal casting moulds for the purpose of identification.

Our U.S. Pat. No. 3,934,639, describes and claims a method of marking an ingot which comprises locating an indicia-defining body on one or more faces of the interior of an ingot mould prior to casting molten metal into the mould. The indicia-defining bodies are each formed of a foam plastics substrate having bonded refractory material throughout (i.e. on and in) its structure and may be fixed to the ingot mould wall by a variety of techniques, for example, by nails fired from suitable guns and by adhesives.

Various types of adhesives have been proposed. However, they all fail to meet the stringent requirement of always operating satisfactorily despite the various conditions of use of the ingot mould. In practice the condition of the mould wall varies greatly; the wall can be smooth and relatively clean or it may be dirty, badly fissured or coated with a mould dressing. It is not practical to require the steel worker to pre-clean the area of the ingot mould wall where the indicia-defining bodies are to be fixed since this is too expensive and time consuming. Furthermore, the mould wall temperature may very greatly, e.g. from about 20° C to more than 250° C.

Certain two-pack adhesives are available but these can only be mixed on site in view of their limited shelf life once mixed. Such adhesives are therefore inconvenient and they are also expensive. It is also known to use a contact adhesive in conjunction with a layer of vulcanisable rubber. While this system can provide adequate adhesive properties for some conditions of use it does not have adequate adhesive properties under all conditions of use, and its application to the indicia-defining bodies during their manufacture can be too time consuming.

It is possible to pretreat the mould wall with a primer to consolidate loose surface material and cause it to adhere to the sound metal of the mould. However, while the use of a primer can reduce the demands on the adhesive, this again involves an additional operation which is labour intensive and expensive. Furthermore, primer compositions are usually disadvantageous in that they can evolve poisonous or inflammable vapours.

According to the present invention there is provided a method of fixing a shaped body of refractory material to an interior face of an ingot mould, which method comprises applying to either the body or the face or both a mixture consisting essentially of aqueous alkali metal silicate and a particulate refractory material, the mixture having a viscosity of at least 2000 poises measured on a Brookfield Viscometer model RVT at 20° C, and urging together the body and the face.

BRIEF DESCRIPTION OF THE DRAWING

The drawing FIGURE is a schematic showing of a shaped body of refractory material having the adhesive of the invention applied thereto in use for practicing the method according to the invention.

DETAILED DESCRIPTION OF THE INVENTION

The shaped body A may be fixed to a face B of an ingot mould anywhere within the interior of the mould, such as on a wall of the mould, including a wall of a head box, or on a hot top lining such that it can serve to identify an ingot cast in the mould. Preferably, however, the shaped body is fixed to an interior face of a wall of the mould itself.

The alkali metal silicate may be, for example, sodium silicate, potassium silicate or lithium silicate. Sodium silicate is preferred, and in particular, sodium silicates having a high molar ratio of $SiO_2$:$Na_2O$ e.g. greater than 3:1, since such silicates bond more rapidly.

The particulate refractory material generally should have a melting point of at least 900° C and may be chosen from a wide range of materials. Examples of suitable particulate refractory materials include china clay, silica and zircon. China clay is preferred since it contributes to the strength of the bond produced between the shaped body and the ingot mould wall.

The viscosity of the adhesive mixture of silicate and refractory measured on a Brookfield Viscometer model RVT is preferably in the range of from 2000 to 2800 poises at 20° C.

The adhesive mixture may be prepared simply by stirring sufficient particulate refractory material into the aqueous alkali metal silicate to produce a composition having the desired viscosity. It is to be noted, however, that it is desirable to mix the components of the mixture C together quickly to avoid premature reaction of the alkali metal silicate with carbon dioxide in the air.

Although the adhesive mixture may be applied to the shaped body A or an interior face B of the mould, application to the shaped body is preferred. Application to, for example, the mould wall suffers from disadvantages in that difficulties may arise in correctly locating the shaped body, excessive use of the adhesive mixture may occur, and when the mould is hot premature setting of the adhesive may take place with the formation of a surface skin which prevents wetting of the surface of the shaped body.

The thickness of the adhesive layer applied to the shaped body may vary but a layer of from 5 to 10 mm thick is usually sufficient. For best results the whole of the surface of the shaped body to be adjacent the interior face of the mould is preferably provided with a layer of the adhesive mixture.

The adhesive may be applied to the shaped body or the interior mould face by means of a tool such as a trowel or a pallet knife. Preferably, however, the adhesive is applied using a pressure gun fitted with a suitable nozzle, in the form of rods or "blobs".

After application of the adhesive mixture the shaped body may be urged against the interior face of the mould by hand or by means of a mechanical applicator. Usually application of hand or applicator pressure for about ten seconds is sufficent to secure adhesion of the body to the interior face of the mould.

The shaped body used in the method of the invention may comprise any shape suitable for making an ingot to provide identification thereof. Thus, the body may define one or more characters or letters, digits or numerals or other identifying symbols.

The shaped body may be an indicia-defining body formed of a foam plastics substrate having throughout the substrate a composition comprising particulate refractory material bonded with a refractory binder as described and claimed in our U.S. Pat. No. 3,934,639.

The invention includes a method of casting molten metal to provide a marked ingot, which method comprises pouring molten metal into an ingot mould having a shaped body of refractory material fixed to an interior face of the mould by the fixing method of the invention, and a marked ingot when so cast.

The following Examples will serve to illustrate the invention. Examples 1 and 2 are comparative Examples which describe the use of adhesives which are not suitable under widely varying industrial conditions. Example 3 describes the use of an adhesive according to the invention.

EXAMPLE 1

Digits formed of a polyurethane foam substrate having throughout the substrate a composition comprising particulate refractory material bonded with a refractory binder were prepared as described in our U.S. Pat. No. 3,934,639.

The surface of each digit which was to be fixed to the wall of an ingot mould was covered with a layer of natural unvulcanized rubber to a thickness of from 1.0 to 1.5 mm. This layer in turn was coated with a layer of poly (2 ethylhexyl) acrylate, and the thus-coated surface was provided with a protective covering of siliconised parting paper.

The paper cover was then removed and each digit was handpressed against a surface of an ingot mould wall under a variety of conditions.

It was found that the digits adhered satisfactorily on both cold and hot moulds provided the mould wall surface had been cleaned prior to application of the digit. When the mould wall was covered with a layer of loose dirt the digits fell off the wall after the hand pressure was released.

EXAMPLE 2

An adhesive was prepared consisting of 71.5% by weight of aqueous sodium silicate solution and 28.5% by weight of china clay by stirring the china clay into the sodium silicate solution. The aqueous sodium silicate solution used had a $SiO_2$:$Na_2O$ ratio of 3.3:1, it contained 8.8% by weight $Na_2O$, it had a density of 1.39–1.40 g/cm$^3$ and its total solids content was 37.9% by weight. The viscosity of the adhesive was 160 poises measured on a Brookfield Viscometer model RVT at 20° C.

The adhesive was applied to a number of digits of the type described in Example 1 to give a 5 mm thick layer, and each digit was hand pressed against a surface of an ingot mould wall at various temperatures. At below about 50° C the digits slid down under their own weight.

EXAMPLE 3

An adhesive was prepared containing 60% by weight of the aqueous sodium silicate solution used in Example 2 and 40% by weight of china clay by stirring the china clay into the sodium silicate solution. The viscosity of the adhesive was 2600 poises measured on a Brookfield Viscometer model RVT at 20° C.

When tested in the same way as the adhesive of Example 2 it was found that irrespective of the mould wall temperature, digits coated with the adhesive would remain in place after application of hand pressure for about ten seconds. Also, unlike the adhesive of Example 1, the adhesive of this Example was effective in fixing digits even where the mould wall was covered with a layer of loose dirt.

Similar good results were obtained using other mixtures of aqueous alkali metal silicate and china clay or other particulate refractory material, which mixtures had a viscosity of at least 2000 poises measured as defined above.

It will be seen that using the method of the invention it is possible to fix digits to ingot mould walls under practical conditions where the condition of the mould walls or the temperature of the moulds renders other fixing methods ineffective.

I claim:

1. A method of fixing a shaped body of a refractory material to an interior face of an ingot mould, which method comprises applying to at least one of said body and said face a mixture consisting essentially of aqueous alkali metal silicate and a particulate refractory material, the mixture having a viscosity of at least 2000 poises measured on a Brookfield Viscometer model RVT at 20° C, and urging together said body and said face.

2. A method according to claim 1, wherein the shaped body of refractory material is fixed to an interior face of a wall of the mould.

3. A method according to claim 1, wherein the alkali metal silicate is sodium silicate.

4. A method according to claim 1, wherein the alkali metal silicate is sodium silicate having a molar ratio of $SiO_2$:$Na_2O$ of greater than 3:1.

5. A method according to claim 1, wherein the particulate refractory material is selected from the group consisting of china clay, silica and zircon.

6. A method according to claim 1, wherein the viscosity of the mixture of silicate and refractory is in the range of 2000 to 2800 poises.

7. A method according to claim 1, wherein the mixture of silicate and refractory is applied to a surface of the shaped body.

8. A method according to claim 1, wherein the mixture is applied as a layer having a thickness of from 5 to 10 mm.

9. A method according to claim 1, wherein the shaped body of refractory material is an indicia-defining body formed of a foam plastics substrate having throughout the substrate a composition comprising particulate refractory bonded with a refractory binder.

10. A method of casting molten metal to provide a marked ingot comprising the steps of fixing a shaped body of a refractory material to an interior face of an ingot mould by applying to at least one of said body and said face a mixture consisting essentially of aqueous alkali metal silicate and a particulate refractory material, the mixture having a viscosity of at least 2000 poises measured on a Brookfield Viscometer model RVT at 20° C, and urging together said body and said face, and then pouring molten metal into said ingot mould.

11. An ingot having an identifying marking formed thereon by fixing a shaped body of a refractory material to an interior face of an ingot mould by applying to at least one of said body and said face a mixture consisting essentially of aqueous alkali metal silicate and a particulate refractory material, the mixture having a viscosity of at least 2000 poises measured on a Brookfield Viscometer model RVT at 20° C, and urging together said body and said face, and then pouring molten metal into said ingot mound, and allowing the molten metal to harden.

* * * * *